US005078062A

United States Patent [19]

Mráz

[11] Patent Number: 5,078,062

[45] Date of Patent: Jan. 7, 1992

[54] MANUAL SET FOR SCREEN PRINTING

[75] Inventor: Silvio B. Mráz, São Paulo, Brazil

[73] Assignee: Klinger Industria e Comercio Ltda., Sao Paulo, Brazil

[21] Appl. No.: 629,551

[22] Filed: Dec. 18, 1990

[30] Foreign Application Priority Data

May 17, 1990 [BR] Brazil ..... 9002388

[51] Int. Cl.[5] ..... B41F 15/42

[52] U.S. Cl. ..... 101/123; 101/114

[58] Field of Search ..... 101/114, 123, 124; 118/213

[56] References Cited

U.S. PATENT DOCUMENTS

| | | | |
|---|---|---|---|
| 3,537,406 | 11/1970 | Ort | 101/123 |
| 3,955,501 | 5/1976 | Bubley et al. | 101/123 |
| 4,102,266 | 7/1978 | Porth | 101/124 |
| 4,276,826 | 7/1981 | Bubley et al. | 101/123 |
| 4,287,826 | 9/1981 | Brabec | 101/123 |
| 4,589,336 | 5/1986 | Klemm | 101/123 |

*Primary Examiner*—Edgar S. Burr
*Assistant Examiner*—Stephen R. Funk
*Attorney, Agent, or Firm*—Hoffman, Wasson & Gitler

[57] ABSTRACT

The invention discloses an automatic manual set for screen printing which delivers constant pressure of a squeegee and uniformity in printing. The automatic manual set basically includes an ensemble of four levers inter-clamped by sleeved axles. Provided is anatomic handle, an ink spreading knife, and printing squeegees.

2 Claims, 6 Drawing Sheets

MANUAL SET FOR SCREEN PRINTING

This invention relates to an automatic set for screen printing. The set comprises an ensemble of inter-clamped levers for manual screen printing which produces an invariable impression from a squeegee and a resultant highly uniformed print. This set can be assembled on any angular or parallel printing table, and use of such significantly cuts down on a printer's labor time. The automatic manual set comprises four basic components, and two installation components, and is preferably constructed of a metal, such as iron, steel, or aluminum. The automatic manual set contains a triangular base fixed on a movable bar adaptable to a bracket of any printing equipment. The triangular base incorporates an upper level which can have attached thereto on its upper extreme end a wood or plastic handle. On the other end of the upper lever there is attached by means of a link another lever having an "S" shape. The "S" shaped lever is pivotally attached to the triangular base, and is provided with an ink spreading knife at its lower extremity. The "S" shaped lever has a trapezoidal plate attached to its upper extremity by fastening means. The trapezoidal plate is provided with a large base for a printing squeegee to be affixed thereto.

DETAILED DESCRIPTION OF THE DRAWINGS

Figure 1:
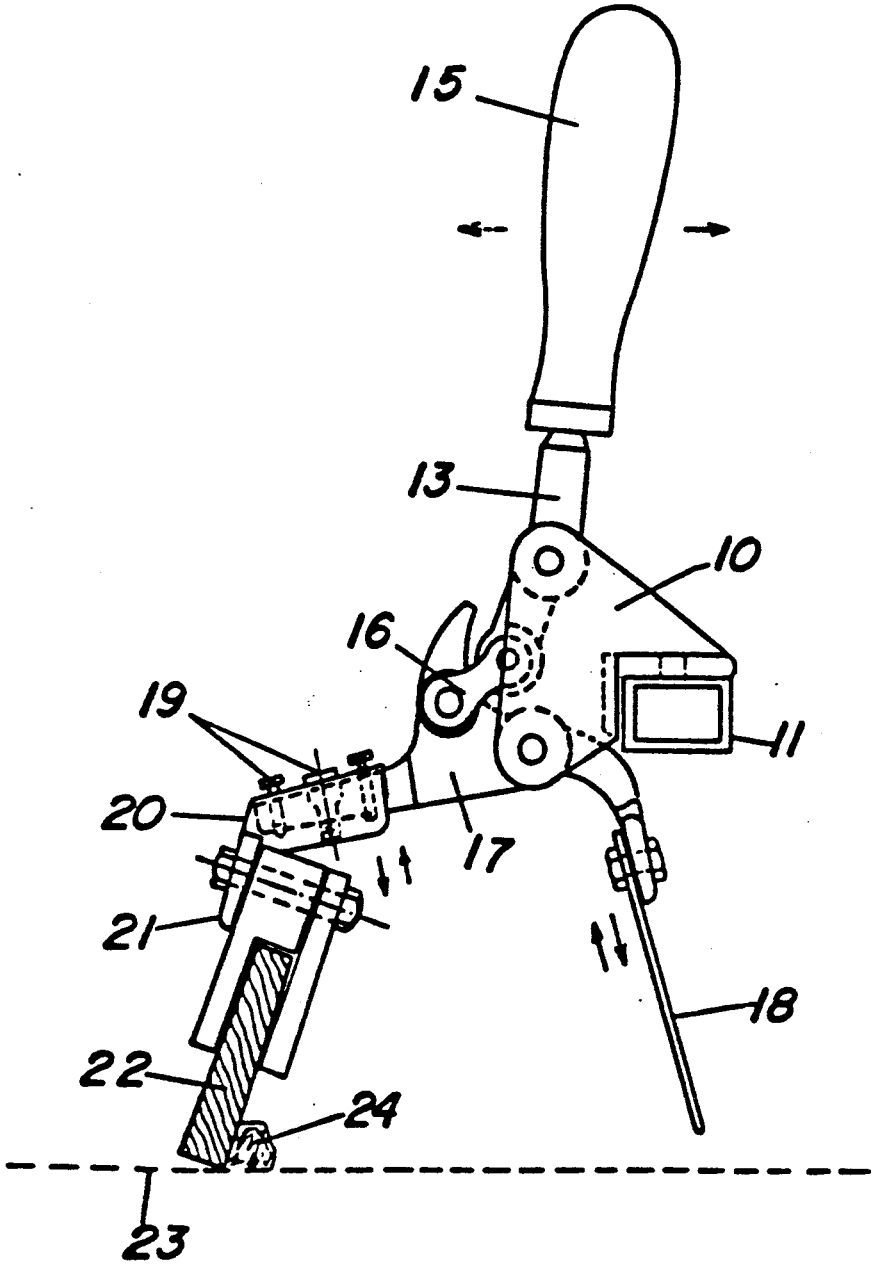
FIG. 1 is a side view of the automatic manual set for screen printing.
Figure 2:
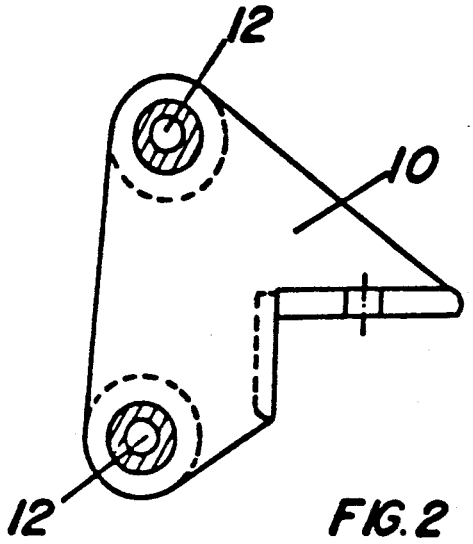
FIG. 2 is a side view of the triangular support.
Figure 3:
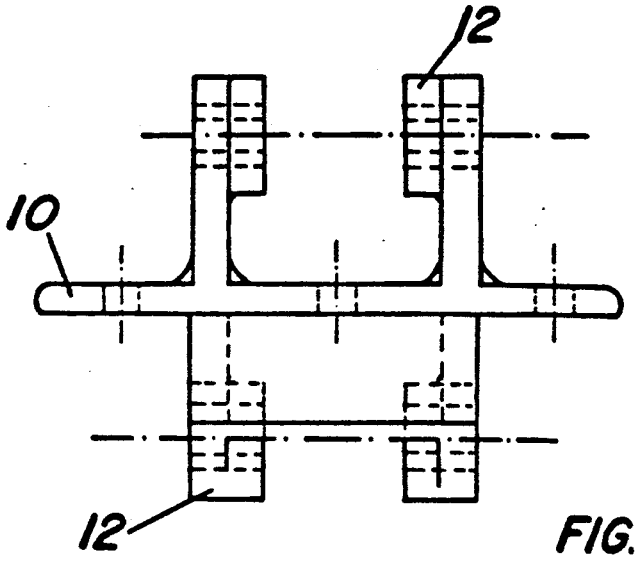
FIG. 3 is a frontal view of the triangular support.
Figure 4:
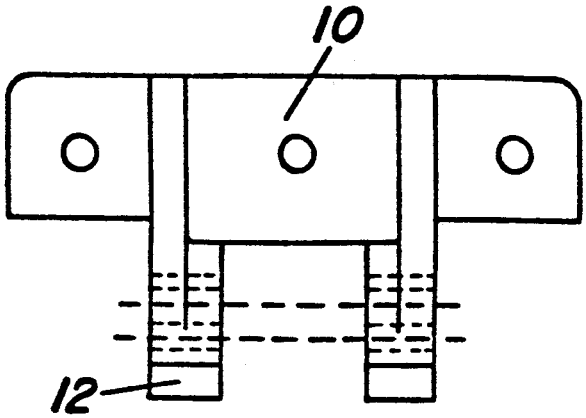
FIG. 4 is a top view of the triangular support.
Figure 5:
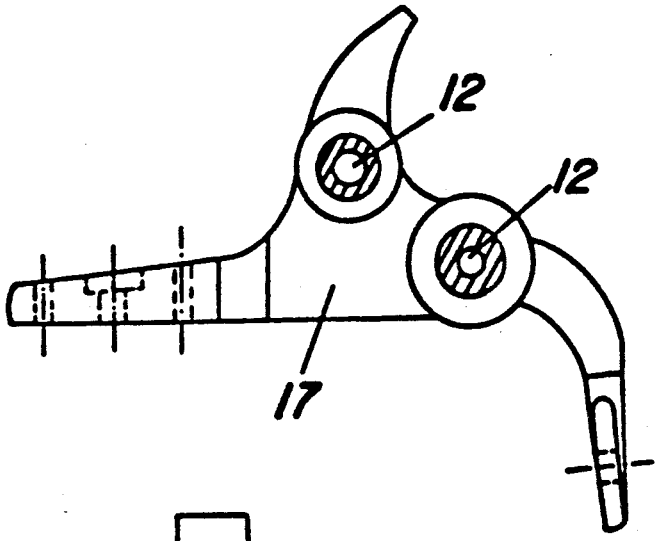
FIG. 5 is a side view of the "S" shaped lever.
Figure 6:
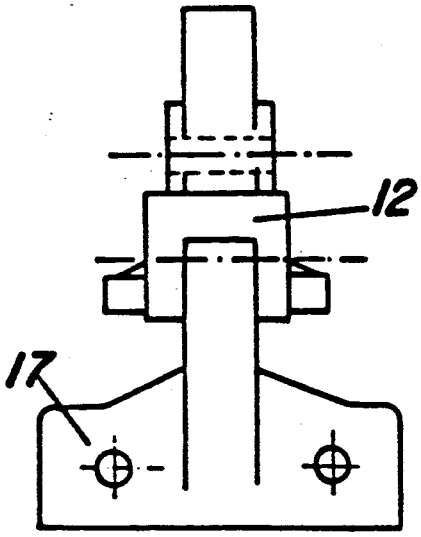
FIG. 6 is a frontal view of the "S" shaped lever.
Figure 7:
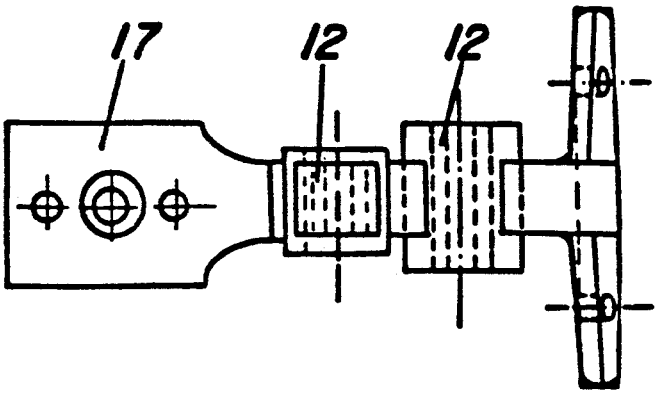
FIG. 7 is a top view of the "S" shaped lever.
Figure 8:
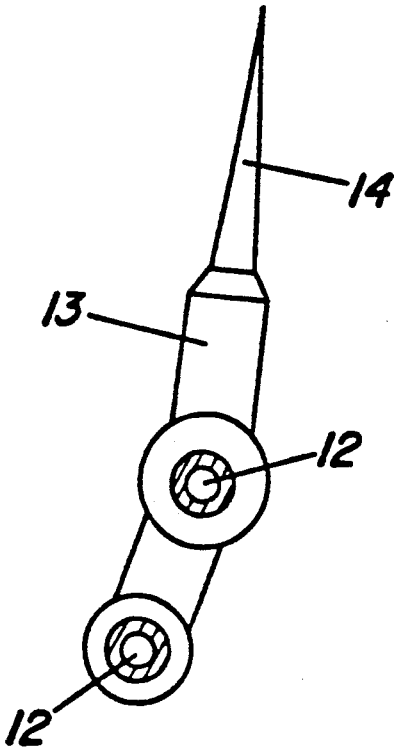
FIG. 8 is a side view of the upper lever.
Figure 9:
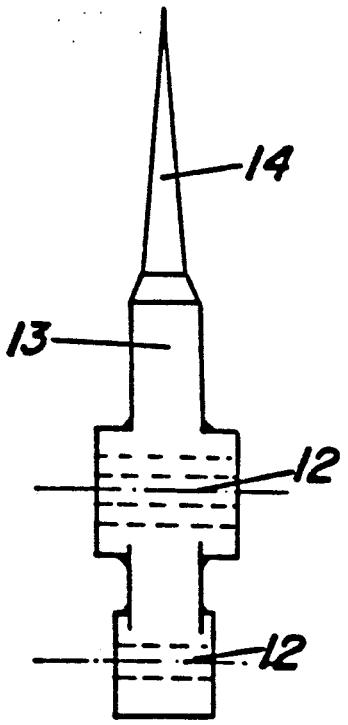
FIG. 9 is a frontal view of the upper lever.
Figure 10:
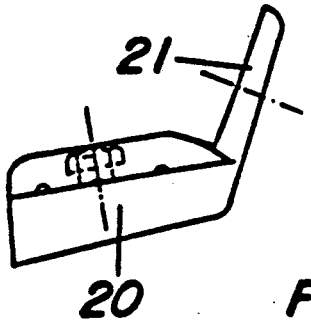
FIG. 10 is a side view of the trapezoidal plate.
Figure 11:
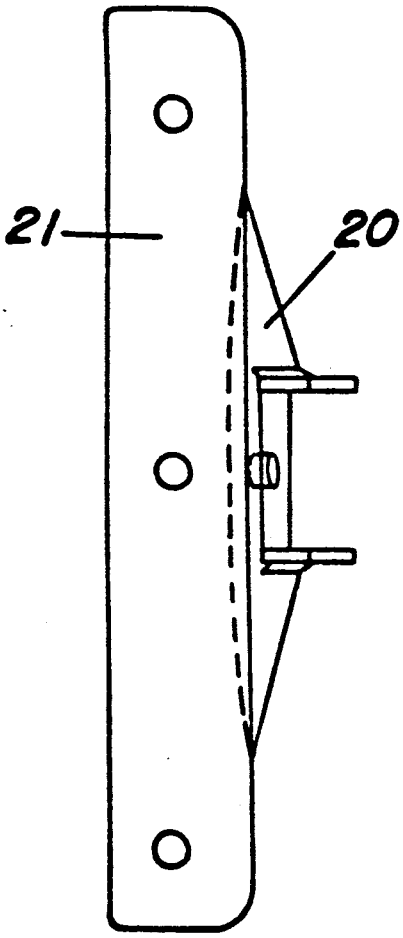
FIG. 11 is a frontal view of the trapezoidal plate.
Figure 12:
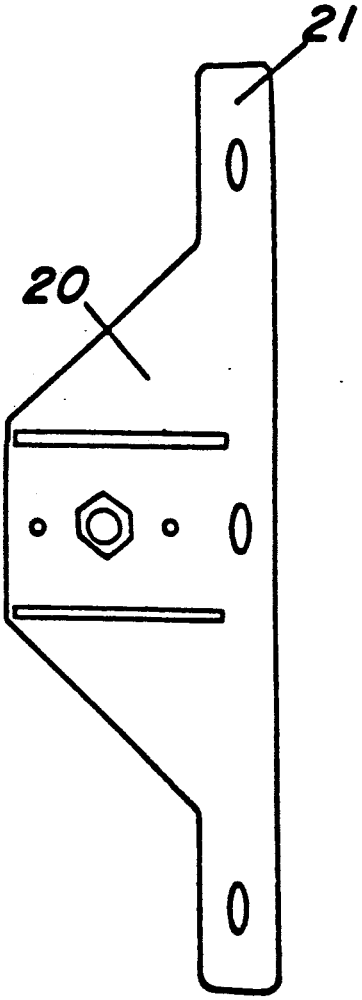
FIG. 12 is a plan view of the trapezoidal plate.
Figure 13:
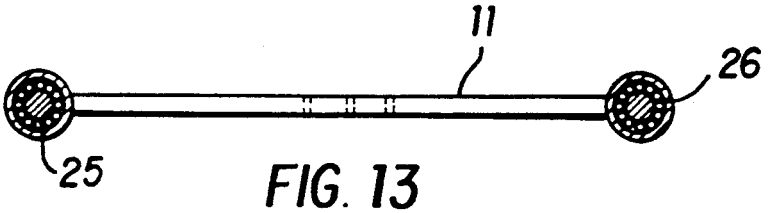
FIG. 13 is a cross sectional view of the movable bar taken along the line 1—1 of FIG. 14.
Figure 14:
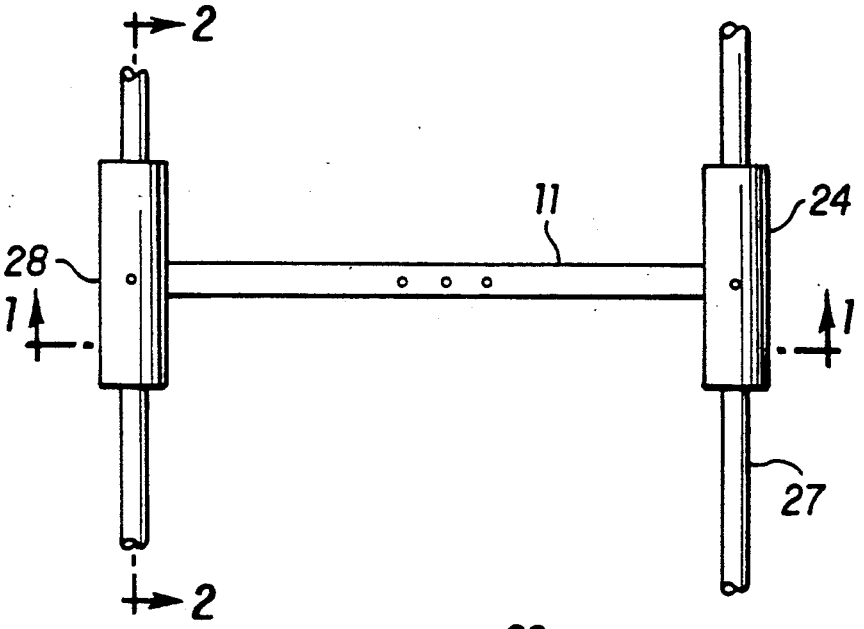
FIG. 14 is a top view of the movable bar.
Figure 15:
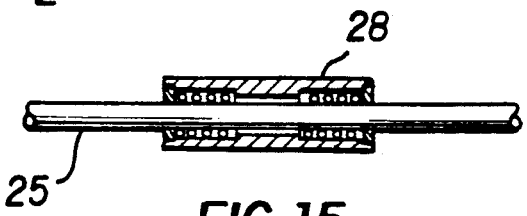
FIG. 15 is a longitudinal section of the bearing support taken along the line 2—2 of FIG. 14.

The automatic manual set for screen printing as depicted in FIG. 1 comprises a substantially triangular medium support base 10 having at one vertex, an "L" shaped cut, which mortises into a movable bar 11 having fixed on both sides of the movable bar 11 thrust ball bearing supports 26 and 28, that possess two parallel steel axles 25 an 27 that can be bracketed to any printing machine. The triangular support base 10 has two sleeved axles 12, to which is attached an upper lever 13 which terminates into a conical pyramid point or screw

14 which is furnished with an anatomic lever or handle 15. The upper lever 13 is hooked by means of a binding link 16, to an "S" shaped lever which is linked to sleeved axle 12 of the support 10. The "S" shaped lever is provided at its lower extremity with an ink spreading knife 18. The "S" shaped lever extends straight and incorporates, by attachment means on its upper extremity, a trapezoidal plate 20 having a large base extending as a rectangular segment at an angle 21 to which it is attached, by means of screws 19, a printing squeegee 22.

The inter-coupling of the triangular base and the upper lever 13 and the "S" shaped lever 17 is accomplished by means of sleeved axles 12.

Similarly, the binding link 16 adjusts between the upper lever 13 and the substantially "S" shaped lever 17 by means of sleeved axles 12.

Thus, the automatic manual set for screen printing offers, a constant pressure on the printing squeegee 22 and, as a result, high uniformity in the resulting print.

In order to better understand the device and its function, FIG. 1 incorporates traced and continuous arrows which illustrate, respectively, the movement of the parts of the set at locked and unlocked positions of the squeegee.

When an operator pulls the lever 15 to the printing position, restraining the squeegees 22 at a desired position, the squeegee presses against the stencil 23 uniformly spreading the ink 24 giving a constant perfect impression upon the stencil 23. When the operator unbrakes the set, pushing the lever, according to the direction of the sketched arrow, the squeegee 22 is automatically unbraked and lifted, oppositely the spreading knife 18 lowers, spreading the ink 24 again, over the stencil.

I claim:

1. A manual set for screen printing comprising:

a) a movable bar, a triangular support base having first and second sleeved axles and a vertex shaped into an "L" cut which mortises into said movable bar for attachment to a printing machine;

b) a binding link attached to said second sleeved axles, an "S" shaped lever, and a first upper lever having first and second ends and having sad first end attached to said first sleeved axle and said second end terminating into a pyramidal conic point, wherein said second end has an anatomic lever placed thereon, said first upper lever being hooked to said binding link and to said "S" shaped lever;

c) said "S" shaped lever having an upper and lower extremity, said lower extremity having an ink spreading knife attached thereon;

d) said upper extremity having attached thereto a trapezoidal plate having a printing squeegee connected thereto.

2. A manual set for screen printing as claimed in claim 1, wherein said movable bar has fixed on its ends thrust ball bearing supports that glide over two parallel steel axles for bracketing said set to a printing machine.

* * * * *